United States Patent [19]

Savenije

[11] Patent Number: 4,525,886

[45] Date of Patent: Jul. 2, 1985

[54] BODY SUPPORT ADAPTED TO DIFFERING VOLUME TO WEIGHT RATIOS

[75] Inventor: Franciscus G. Savenije, Schalkhaar, Netherlands

[73] Assignee: Auping B. V., Netherlands

[21] Appl. No.: 463,478

[22] Filed: Feb. 3, 1983

[30] Foreign Application Priority Data

Feb. 3, 1982 [NL] Netherlands ..... 8200401

[51] Int. Cl.[3] ..... A47C 23/06; A47C 27/08; A47C 31/12

[52] U.S. Cl. ..... 5/464; 5/236 R; 5/449

[58] Field of Search ..... 5/236 R, 238, 191, 239, 5/247, 464, 449, 450, 451, 455, 458

[56] References Cited

FOREIGN PATENT DOCUMENTS

| | | | |
|---|---|---|---|
| 0005272 | 11/1979 | European Pat. Off. | 5/191 |
| 0011755 | 6/1980 | European Pat. Off. | 5/464 |
| 0038155 | 10/1981 | European Pat. Off. . | |
| 2621803 | 5/1976 | Fed. Rep. of Germany . | |
| 2832584 | 7/1978 | Fed. Rep. of Germany . | |
| 7332708 | 9/1973 | France . | |
| 2407692 | 7/1979 | France | 5/449 |
| WO81/02384 | 9/1981 | PCT Int'l Appl. | 5/464 |

OTHER PUBLICATIONS

"Wood Slat & Air Bed", *Bedding Magazine*, Jun. 1981.

*Primary Examiner*—Alexander Grosz
*Assistant Examiner*—Vinh Luong
*Attorney, Agent, or Firm*—Leydig, Voit, Osann Mayer and Holt, Ltd.

[57] ABSTRACT

A body support comprising one or more flexible containers and a plurality of load transmitting elements which have contact surfaces the area of which at a number of elements differs from the area of other elements to obtain an adaptation to the differing ratio of volume to weight of the parts of the human body, and a container which can be used in the body support which container has two outer layers of nonpermeable material and two inner layers all layers, being interconnected by cross seams to form chambers interconnected at the edges.

16 Claims, 10 Drawing Figures

BODY SUPPORT ADAPTED TO DIFFERING VOLUME TO WEIGHT RATIOS

The invention is related to a body support in particular for the human body comprising one or more fluid filled flexible containers, such as sacks or hoses, a flexible and/or elastic upper mattress positioned thereabove and a number of load transmitting elements between the upper mattress and the container or containers.

Such a body support is known, e.g. from the periodical "Bedding Magazine" dated June 1981. This known body support comprises air-filled hoses located at the longitudinal edges of the support structure. Upon these hoses, cross-slats are provided and the upper mattress is laid above the body support. In this known body support the cross slats all rest with the same area upon the air hoses and on each cross-slat-end the same force per surface unit acts resulting from the pressure and determined by the total weight load.

From U.S. Pat. No. 2,638,606 a body support is known comprising a rigid base plate, a number of elastic blocks which are uniformly distributed over the surface of the base plate which blocks are present in an air-tight chamber with a throttling port in which parallel slats of the same widths are positioned over the blocks.

The human body has parts that not only differ concerning their shape but also concerning their weight to volume ratio. This results in the fact that large but relatively light parts such as the chest-shoulder-part, when certain positions of the human body are assumed, penetrate less deep than the heavier parts that may be smaller as, for example, pelvis parts. Notwithstanding the more uniform distribution of the load this known body support still does not result in a correct position of the body.

The aim of the invention is to provide a body support with which the ideal position of the body resting thereon can be obtained in a better way.

This aim according to the invention is obtained by the fact that these load transmitting elements are in contact with the flexible container or containers and/or the upper mattress over an area that at least for a number of elements differ from those of the other elements, in accordance with the differing ratios of volume to weight of the several parts of the human body.

By varying the contact areas of the load transmitting elements in accordance with such differing ratios, independent of the total volume and weight of the body, the weight is equalized by the pressure of the fluid acting on the areas of contact. By a correct choice of the contact areas of the load transmitting elements it is now possible to obtain the desired deeper or less deep penetration in the container filled with fluid, so that when on a certain place a deeper penetration is necessary because of the fact that the shape of the body requires this, the lower side of those elements which have to penetrate deeper must have a contact area that is smaller than that of the other elements.

With the body support known from the periodical "Bedding Magazine", in which the flexible container comprises two hoses near the longitudinal axes of the support and in which the elements comprise transverse slats, the invention can be realized in a simple manner by the fact that the slats at their extreme ends are provided with rods of the same diameter, that abut the hoses and in that between a number of rods and the hoses pressure pieces are present having a width that is greater than the diameter of the rods and having space for receiving the rods. In this case it is only necessary to have a number of pressure pieces with differing widths that can be positioned as desired between the rods and the hoses. The rods themselves then may form the narrowest surface and therefore also the deepest penetrations. Where less penetration is desired, pressure pieces of suitable widths are provided. These are kept in place because of the fact that the rods rest in the slits. However, this construction has the disadvantage that the frame on which the body support has to rest becomes heavy and wide and consequently the total width of the bed is increased.

A more effective embodiment of the body support according to the invention can be obtained in which the elements comprise blocks that are mounted on the lower side of the upper mattress, which blocks on their lower face rest on a flexible holder and in which the lower face differs from that of the other blocks. These blocks, that abut a flexible holder with adapted surfaces, may each comprise the frustum of a pyramid pointed downwardly or ridges extending perpendicular to the longitudinal axis of the support. Such an upper mattress also can be used separately as a camping mattress in which the blocks in that case rest on a hard undersoil. The flexible holder in that case has dimensions that in principle correspond with the length and the width of the upper mattress. The flexible holder may comprise a flat fillable sack filled with fluid but advantageously comprises a number of compartments that are directed parallel to each other and adjacent each other. In case it is desired to keep this construction simple, it is preferred that the compartments of the flexible holder that extend perpendicularly to the longitudinal axis of the support have mid-center-planes that coincide with the mid-center planes of the blocks extending in cross direction or forming a row.

The contact face of a block, pyramid or ridge in that case is in the middle of a compartment. In all embodiments in which the flexible holder comprises more compartments it is preferred that these only can be connected to each other through throttling parts so that at local loading no sudden pressure shocks can arise.

An effective construction for the body support according to the invention comprises a base plate, upstanding longitudinal or side walls, end walls of an elastic foam placed on the edges of the base plate, and an upper layer of foam and blocks mounted to the lower side of the upper layer comprising layers that have an increasing hardness in the direction of the flexible container, in which the flexible container is enclosed between longitudinal and end walls.

The flexible container according to the invention may comprise two outer layers of non-permeable material and two inner layers, which layers are mutually connected by cross seams in such a manner that between the mutually spaced and parallel extending seams of each inner layer, both inner layers are mutually welded to the nearby outer layer according to a seam extending parallel to the other seams. Such a container is suited for use in the body support according to the invention, but is also useful independently of it, e.g. as an air mattress.

The flexible holder comprising four layers can be produced in a very simple way. It is preferably produced in such a manner that the outer layers encircling the circumference of the container are welded together, keeping those edges of the inner layers that extend parallel to the longitudinal axis free. The ends of the compartments extending in cross direction that are defined by the edges of the two inner layers end a short distance from the side walls formed by the mutually welded outer layers. This small distance forms the throttling port through which air may flow from one compartment to the other.

With the aid of the drawings the invention now will be elucidated.

Figure 7:
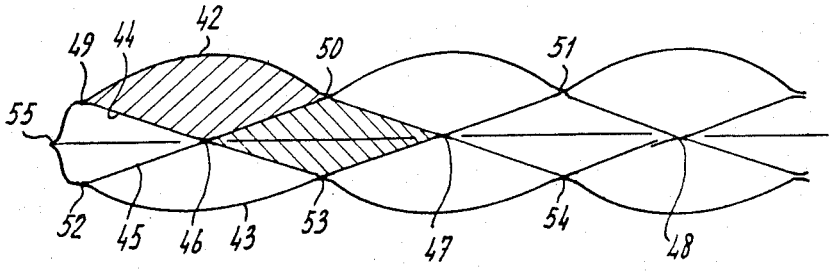
FIG. 7 shows the longitudinal section of the flexible holder that can be used in the body support according to the invention and as body support.
Figure 8:
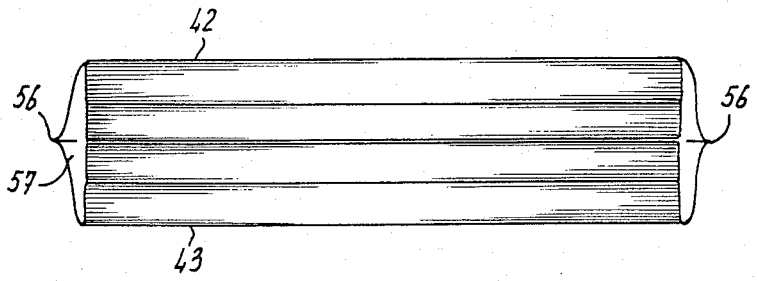
FIG. 8 is a cross-section of the flexible container of FIG. 7.
Figure 9:
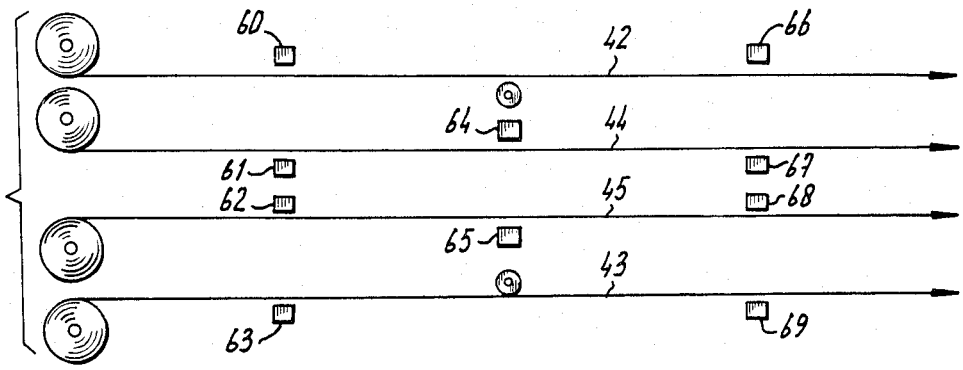
Figure 10:
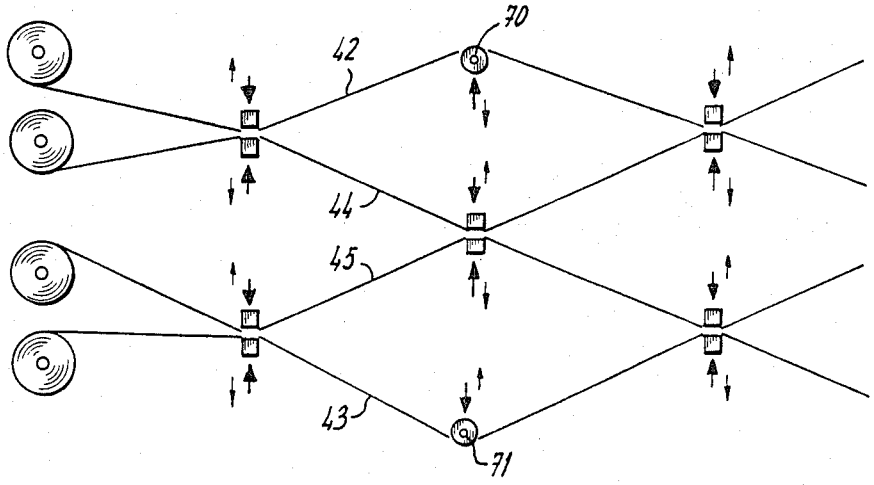

FIGS. 9 and 10 schematically show the way in which the flexible container according to FIGS. 7 and 8 can be manufactured.

Figure 1:
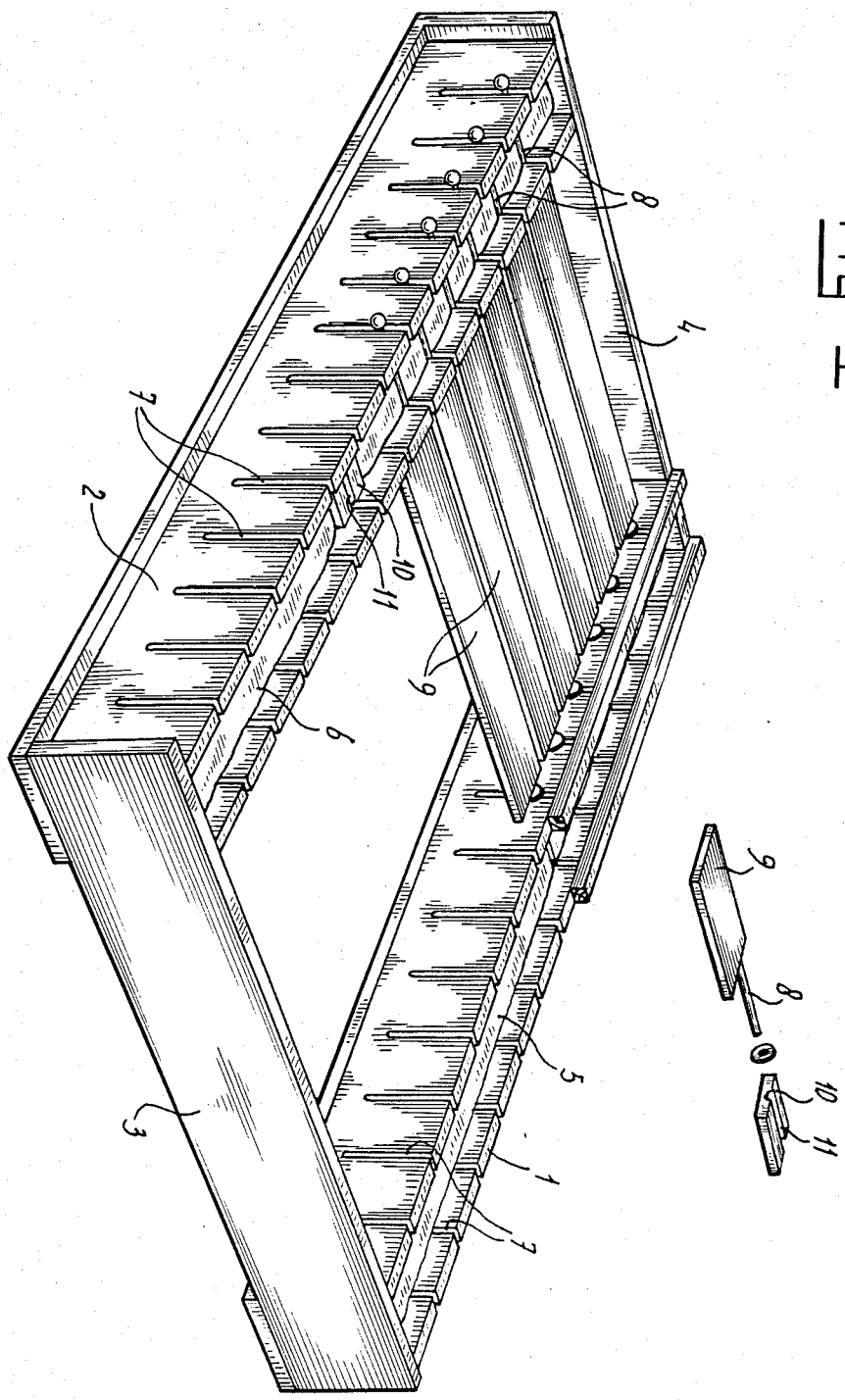
FIG. 1 shows in perspective a first possible embodiment.

FIG. 1 shows a frame with longitudinal boxes 1 and 2 mutually connected by cross boards 9. In the longitudinal boxes 1 and 2 air hoses 5 and 6 are present. The side walls of the longitudinal boxes are provided with slits 7, through which rods 8 that are connected to cross slats 9 extend. These rods 8 rest on the air hoses 5 and 6.

Between these rods and the air hoses pressure pieces 10 can be present that may have different widths and that are provided with a semicylindrical slit 11 for receiving the rods 8 in such a manner that the pressure pieces 10 are not able to move with regard to the rods nor with regard to the hoses 5 and 6. Where the surface of the plane resting on the hoses is extended with the aid of pressure pieces 10, the penetration of the rods 8 will be less. Where the surface area of pressure pieces 10 is smaller, the penetration of the rod 8 will be deeper while the inner pressure in the hose is the same along the whole length. The hose can be filled with a gas-like medium under pressure, such as air, or it can be filled with a liquid.

Figure 2:
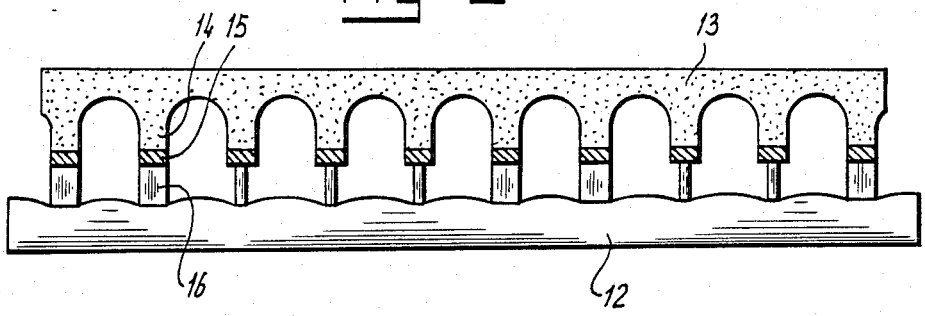
FIG. 2 shows a longitudinal section of another embodiment.

In the embodiment shown in FIG. 2 two air pockets 12 can be applied in the same way as shown in FIG. 1. However, it is also possible to have just a single air pocket of which the length and width correspond with the length and the width of the upper mattress 13. This upper mattress comprises foamed rubber or foam plastic, such as polyether and this upper mattress at its lower side is provided with cross ribs 14 together with slats or other cross stiffeners 15, that abut the air pockets or air pocket 12 by means of pressure pieces 16, of which the contact surface with the air pockets or air pocket is of differing areas.

The slats 15 may comprise a foamed plastic strip with higher stiffness and the cross ribs 14, cross stiffeners 15 and pressure pieces 16 a single unit. This in particular is important where pressure pieces may rest on a single air pocket 12.

Figure 3:
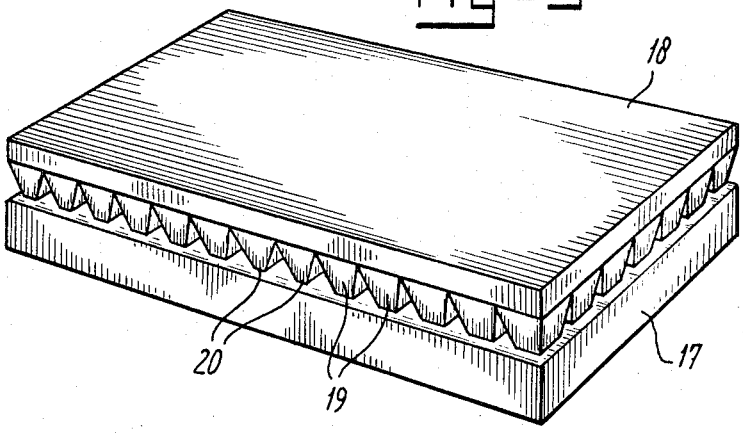
FIG. 3 shows in perspective a third embodiment.
Figure 4:
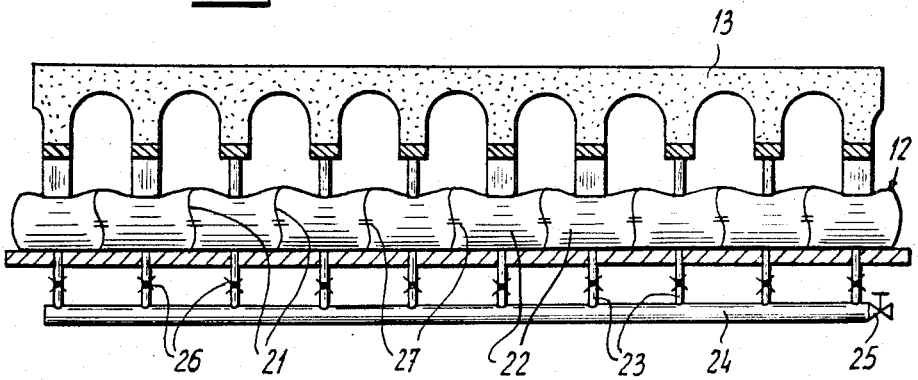
FIG. 4 shows a variation of the embodiment of FIG. 2.

In the embodiment shown in FIG. 3 a single air pocket 17 is used and an upper mattress 18, provided at the lower side with frustums of pyramid-shaped elements 19 that may differ in dimension as indicated at 20. The upper mattress 18 can also be used as a separate element, for instance as a camping mattress, perhaps in combination with an air pocket. The pyramid-shaped elements have different load supporting capacities when situated upon a hard layer as a result of their difference in dimension. FIG. 4 shows an embodiment in which the air pocket 12 is divided in compartments 22 by cross beams 21. These compartments 22 are each connected through a line 23 to a filling line 24 having a valve 25. In the lines 23, throttling ports 26 can be present through which the flow of the fluid from one compartment 22 to another compartment only can take place slowly. Instead of the throttling ports 26, throttling ports 27 can be mounted in the cross beams 21.

The upper mattress 13 shown in FIGS. 2 and 4 with cross ribs 14, stiffeners 15 and pressure pieces 16 may consist of integrated plastic foam layers with increasing hardness from above to below. On such a block of plastic foam comprising different integrated layers the desired shape can be given by machining or sawing in which case the pressure pieces obtain the required contact surface.

Figure 5:
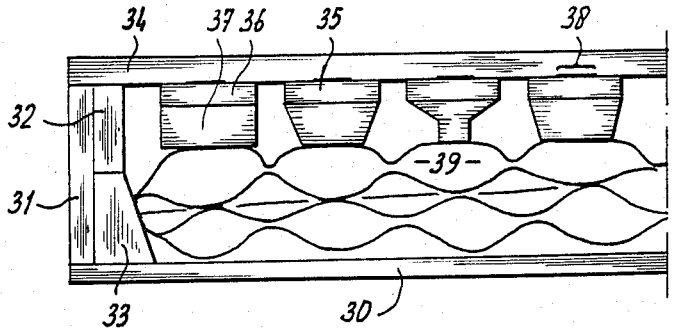
FIG. 5 shows a further embodiment in longitudinal section.
Figure 6:
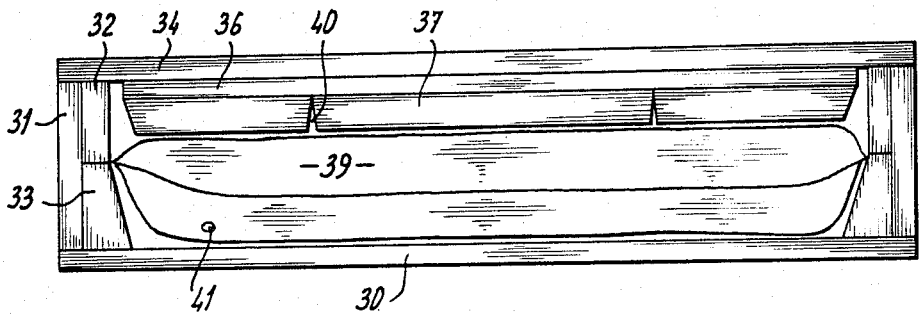
FIG. 6 shows a cross-section of the embodiment of FIG. 5.

The FIGS. 5 and 6 show a complete body support or mattress comprising a lower plate 30 that can be made out of stiff material if the mattress is to be supported on several points or of flexible material if the mattress is to be positioned on a hard underlayer. This mattress comprises side walls and end walls that are built up out of plastic foam blocks 31, 32 and 33 as well as a foam upper layer mattress 34 on the lower side of which blocks or cross ribs 35 are connected, that, as shown in FIG. 5, may have different contact surfaces and that may comprise blocks or layers 36 and 37 of increasing hardness from top to bottom. These cross ribs 35 are connected by a narrow strip 38 that increases the flexibility.

The flexible holder or air pocket 39 consists of a number of compartments and is completely enclosed in the mattress.

As shown in FIG. 6 cross ribs 35 may be interrupted at 40. A filling valve 41 is indicated.

The FIGS. 7 and 8 show the construction of the air pocket 39 and the FIGS. 9 and 10 show the manufacturing of it.

This air pocket comprises two outer layers 42, 43 and two inner layers 44, 45, that are connected to each other by a number of parallel cross seams. The inner layers 44 and 45 are connected at 46, 47, 48 and so on. The upper inner layer 44 is connected to the outer layer 42 at 49, 50, 51, etc. and the lower inner layer 45 is connected to the outer layer 43 at 52, 53, 54 etc.

The outer layers 42 and 43 are longer and wider than the inner layers 44 and 45. The end edges of the layers 42 and 43 are welded together at 55 and at the longitudinal edges 56. At the spot of the longitudinal edges a space 57 is present between the side edges of the inner layers 44 and 45 and the outer layers by which the compartments are connected to each other in such a manner that the compartments provide throttling characteristics due to their proportion to the space 57.

FIGS. 9 and 10 show that such an air pocket can be manufactured in a simple way by supplying layers 42 through 45 from storage rollers along welding electrodes 60 to 69, the welding electrodes being movable in planes perpendicular to the layers.

FIG. 10 shows that with the mutual approach of the electrodes 60, 61, the electrodes 62, 63, the electrodes 66,67 and the electrodes 68,69, cross seams can be formed between an outer layer and an inner layer.

The connection between the inner layers 44, 45 may be obtained by moving the electrodes 64, 65 toward each other preferably while moving the support rollers 70 and 71 outward.

In this manner, the electrodes can be freed from the webs. Alternatively, the electrodes can be freed from the webs by a relative cross movement since the electrodes are clamped in a support at one end.

The air pocket manufactured in this way can also be used as independent air bed.

I claim:

1. A body support device having a primary axis parallel to the direction of a centerline of a human body which the support device is adapted to support comprising:

at least one flexible container adapted to be filled with a fluid medium, said at least one flexible container lying coextensive with at least a portion of the device and arranged parallel to the primary axis;

a flexible mattress having longitudinal edges, said mattress positioned above said flexible container; and a plurality of load transmitting elements having lower surfaces of varying shapes, said plurality of load transmitting elements arranged between said mattress and said flexible container, said flexible container being in contact with at least two adjacent load transmitting elements, the shapes of the lower surfaces varying from each other in accordance with the volume to weight ratios of the several parts of the human body which the device is adapted to support.

2. Body support device according to claim 1 wherein the upper faces of said load transmitting elements have shapes varying from each other in accordance with the volume to weight ratios of the several parts of the human body which the device is adapted to support.

3. Body support device according to claim 1, said mattress comprising a plate of elastic foam material that on one side is provided with rows of separate blocks of elastic foam material laying adjacent to each other which blocks partly have different lower surfaces.

4. Body support device according to claim 1, said elements having substantially identical upper faces.

5. Body support device according to claim 1 or 4 in which said flexible containers comprise two hoses near said longitudinal edges of said upper mattress and said elements comprise cross slats, said slats at their extreme ends being provided with rods of the same diameter that abut the hoses and between a number of rods and said hoses, pressure pieces being present having a width greater than the diameter of said rods and having a groove for taking up said rods.

6. Body support device according to claim 1 or 4, said elements comprising blocks mounted on the lower surface of said upper mattress, which blocks on their lower surfaces contact said container.

7. Body support device according to claim 6, said blocks comprising frustum pyramids with the narrower ends of said frustrums directed downwardly.

8. Body support device according to claim 6, said blocks comprising ridges extending perpendicularly to the longitudinal axis of the support, which ridges are mounted on said lower side of said upper mattress.

9. Body support device according to claim 6, said flexible container comprising a flat container substantially coextensive upper mattress.

10. Body support device according to claim 6, said flexible container comprising a number of parallel and adjacent compartments directed perpendicularly to said longitudinal axis of said support.

11. Body support device according to claim 10, said compartments of said flexible container extending perpendicularly to said longitudinal axis of said support comprise mid-center planes that coincide with the mid-center planes of said blocks extending in cross direction forming a row.

12. Body support device according to claim 10, said compartments being connected to each other via throttling ports.

13. Body support device according to claim 6 comprising a ground plate, upstanding side walls and end walls of an elastic foam material positioned on the edges of the ground plate, said flexible mattress comprising foam material, said blocks comprising layers of varying hardness, which hardness increases in the direction of the flexible container, in which said flexible container is enclosed between longitudinal end walls.

14. Flexible container for use with a body support according to claim 6 said flexible container comprising two outer layers of non-permeable material and two inner layers, which layers are mutually connected to each other by cross seams in such a manner that between said mutually spaced seams of each inner layer extending parallel to the nearby outer layer, both inner layers are mutually welded according to a seam extending parallel to the other seams.

15. Flexible container according to claim 14, said outer layers encircling the circumference of said container keeping said edges of said inner layers that extend parallel to the longitudinal axis free.

16. A body support device having a primary axis comprising:

at least one container adapted to be filled with a fluid medium, said at least one flexible container lying coextensive with at least a portion of the device and arranged parallel to the primary axis;

a flexible mattress having longitudinal edges, said mattress positioned above said flexible container; and a plurality of load transmitting elements having lower surfaces of varying shapes, said plurality of load transmitting elements arranged between said mattress and said flexible container, the shapes of the lower surfaces varying from each other in accordance with the volume to weight ratios of the several parts of the human body which the device is adapted to support.

* * * * *